US010131587B1

(12) United States Patent
Diviacchi

(10) Patent No.: US 10,131,587 B1
(45) Date of Patent: Nov. 20, 2018

(54) WHITE SMOKE MIX

(71) Applicant: U.S. Army Edgewood Chemical and Biological Center, Washington, DC (US)

(72) Inventor: Giancarlo Diviacchi, Baltimore, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/282,109

(22) Filed: Sep. 30, 2016

(51) Int. Cl.

| | |
|---|---|
| ***C06B 33/00*** | (2006.01) |
| ***C06B 33/02*** | (2006.01) |
| ***F41H 9/06*** | (2006.01) |
| ***F17C 5/00*** | (2006.01) |
| *D03D 23/00* | (2006.01) |
| *D03D 43/00* | (2006.01) |

(52) U.S. Cl.
CPC ..... *C06B 33/02* (2013.01); *F17C 5/00* (2013.01); *F41H 9/06* (2013.01); *F17C 2221/03* (2013.01)

(58) Field of Classification Search
USPC ..... 149/37, 44, 108.2, 109.4
See application file for complete search history.

(56) References Cited

U.S. PATENT DOCUMENTS 4,697,521 A * 10/1987 Espagnacq ..... C06D 3/00 102/334
6,414,040 B1 * 7/2002 Van Driel ..... C06D 3/00 102/289

* cited by examiner

*Primary Examiner* — James E McDonough
(74) *Attorney, Agent, or Firm* — Ulysses John Biffoni

(57) ABSTRACT

A mixture and method of creating the mixture includes mixing hexachloroethane, stannous oxide, and aluminum together. The mixture may be loaded into at least one canister. The mixture may be combusted to create a smoke screen. The loading of the mixture into the at least one canister may include pressurized loading at loading pressures in the range of approximately 2300 psi to 3600 psi. The hexachloroethane may include approximately 30-40 parts by weight of the mixture and have a particle size of approximately less than 850 μm. The stannous oxide may include approximately 55-65 parts by weight of the mixture and have a particle size of approximately less than 150 μm. The aluminum may include approximately 5-10 parts by weight of the mixture and have a particle size of approximately less than 45 μm. The mixture is devoid of zinc chloride.

11 Claims, 2 Drawing Sheets

WHITE SMOKE MIX

GOVERNMENT INTEREST

The embodiments herein may be manufactured, used, and/or licensed by or for the United States Government without the payment of royalties thereon.

BACKGROUND

Technical Field

The embodiments herein generally relate to pyrotechnics, and more particularly to pyrotechnics used for smoke screens.

Description of the Related Art

Conventional smoke formulations contain hexachloroethane, zinc oxide, and aluminum.

$$C_2Cl_6+3ZnO+2Al \rightarrow 3ZnCl_2+Al_2O_3+2C$$

This pyrotechnic reaction produces a large volume of zinc chloride which has been proven to be a toxic substance. There have been several tests performed demonstrating the toxic effects this substance has had on the environment and upon human inhalation. There are several conventional smoke formulations, and while many have been proven to be less toxic than the above formulation, they tend to lack the same screening effect as zinc chloride. These conventional formulations generally do not produce comparable percentages of products that have hygroscopic properties. Accordingly, there is a need for a new pyrotechnic formulation that overcomes the drawbacks and disadvantages of the above-indicated (zinc chloride containing) formulation, while at the same time achieves comparable screening abilities.

SUMMARY

In view of the foregoing, an embodiment herein provides a mixture comprising hexachloroethane, stannous oxide, and aluminum. The hexachloroethane may comprise approximately 30-40 parts by weight of the mixture. The stannous oxide may comprise approximately 55-65 parts by weight of the mixture. The aluminum may comprise approximately 5-10 parts by weight of the mixture. The hexachloroethane may comprise a particle, and the hexachloroethane particle size may comprise approximately less than 850 μm. The stannous oxide may comprise a particle, and the stannous oxide particle size may comprise approximately less than 150 μm. The aluminum may comprise a particle, and the aluminum particle size may comprise approximately less than 45 μm. The mixture is devoid of zinc and does not produce zinc chloride.

Another embodiment provides a method comprising mixing hexachloroethane, stannous oxide, and aluminum together to create a mixture. The method may further comprise loading the mixture into at least one canister. The method may further comprise combusting the mixture to create a smoke screen. The loading of the mixture into the at least one canister may comprise pressurized loading. The pressurized loading may comprise loading pressures in the range of approximately 2300 psi to approximately 3600 psi. The hexachloroethane may comprise approximately 30-40 parts by weight of the mixture. The stannous oxide may comprise approximately 55-65 parts by weight of the mixture. The aluminum may comprise approximately 5-10 parts by weight of the mixture. The hexachloroethane may comprise a particle, and the hexachloroethane particle size may comprise approximately less than 850 μm. The stannous oxide may comprise a particle, and the stannous oxide particle size may comprise approximately less than 150 μm. The aluminum may comprise a particle, and the aluminum particle size may comprise approximately less than 45 μm. The mixture is devoid of zinc chloride.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
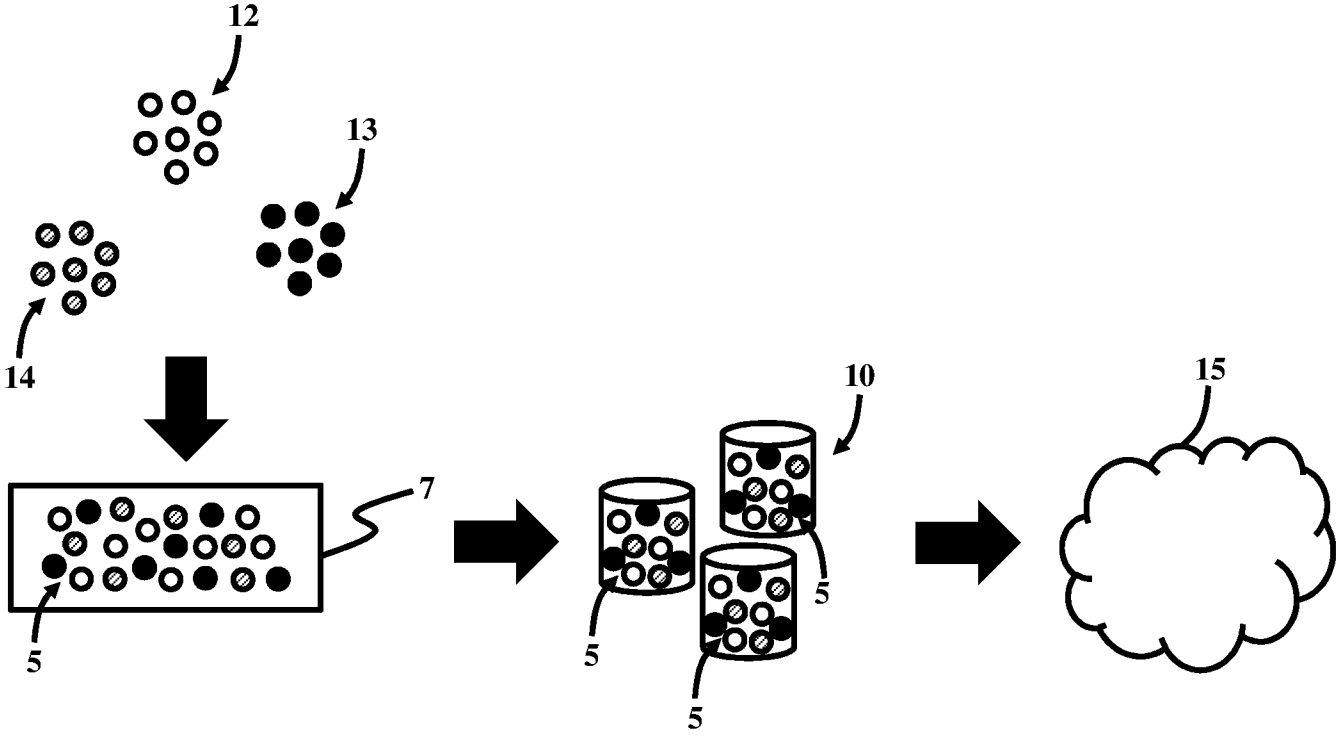
FIG. 1 is a schematic diagram illustrating a mixture process according to the embodiments herein.
Figure 2:
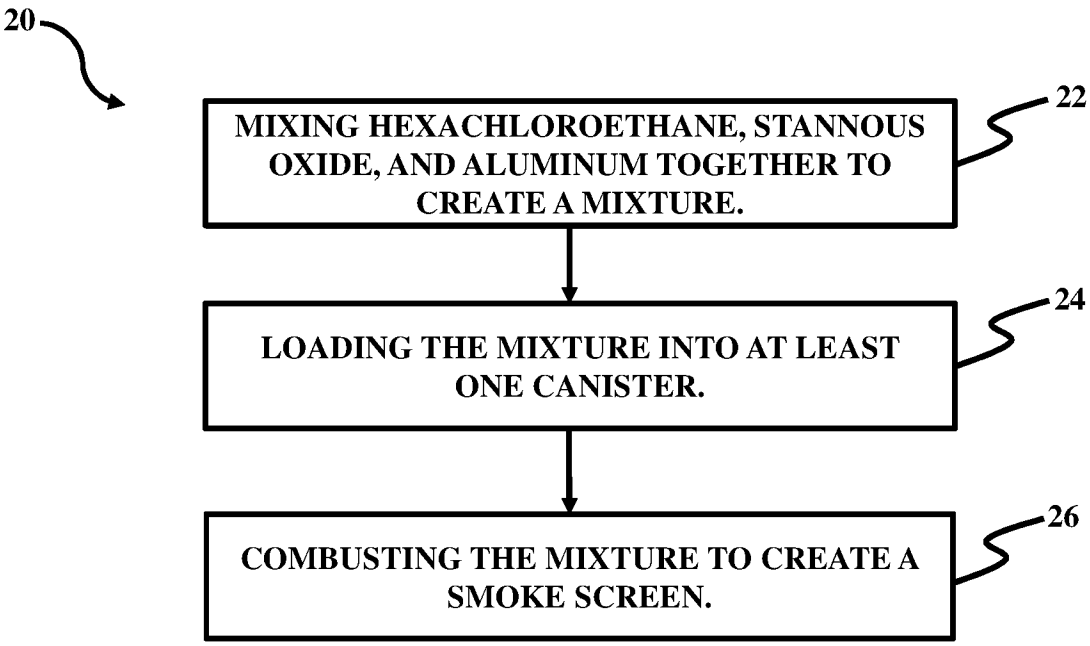
FIG. 2 is a flow diagram illustrating a method according to an embodiment herein.

The embodiments herein provide a pyrotechnic formulation to generate a smoke screen for obscuring effects and for ground-to-air signaling. The formulation provides screening effects but produces less toxic products than the conventional formulations. The screening product comprises stannous chloride, which has less toxic characteristics than the conventional formulations. Referring now to the drawings, and more particularly to FIGS. 1 through 2, where similar reference characters denote corresponding features consistently throughout the figures, there are shown preferred embodiments.

The new smoke formulation provided by the embodiments herein achieves comparable screening coverage as the conventional zinc chloride containing formulation but with a more environmentally friendly and less toxic compound. The formulation of the reaction provided by the embodiments herein is a follows:

$$C_2Cl_6+3SnO+2Al \rightarrow 3SnCl_2+Al_2O_3+2C$$

This reaction produces a large volume of stannous chloride. While stannous chloride has deliquescent properties like that of zinc chloride, stannous chloride is much more environmentally friendly than zinc chloride and less toxic as well. The three components' parts by weight percentages and approximate particle sizes are shown in Table 1.

TABLE I

| Smoke Formulation | | |
|---|---|---|
| Component | Parts by Weight | Approximate Particle Size |
| Hexachloroethane | 30-40% | Less than 850 μm |
| Stannous Oxide | 55-65% | Less than 150 μm |
| Aluminum | 5-10% | Less than 45 μm |

As shown in FIG, 1, the mixing of these components (e.g., hexachloroethane, stannous oxide, and aluminum) may be performed using a planetary mixer 7. The hexachloroethane contains particles 12, the stannous oxide contains particles 13, and the aluminum contains particles 13. The loose mixture 5 is then pressed in varying increments into selected canisters 10. In exemplary embodiments, loading pressures are between 2300 psi to 3600 psi. Using these loading pressures causes dead loads to vary depending on the size of the canister 10. In an example, for an AN-M8 style grenade, dead loads can be varied between 10,000 and 15,000 lbs. Final dead load and increment sizes can be individually specified for the different configurations for which the smoke formulation will be used. Upon combustion, the mixture 5 creates a smoke screen 15.

The formulation provided by the embodiments herein is distinct from the conventional formulations by the removal of zinc chloride from the smoke products. Past toxicology tests have shown zinc chloride to have negative impacts on the environment and as well as having severe effects on inhalation studies. Conversely, stannous chloride has a much safer toxicology while still achieving the desired smoke screen effect.

FIG. 2, with reference to FIG. 1, is a flow diagram 20 illustrating a method according to an embodiment herein. The method comprises mixing (22) hexachloroethane, stannous oxide, and aluminum together to create a mixture 5. The method may further comprise loading (24) the mixture 5 into at least one canister 10. The method may further comprise combusting (26) the mixture 5 to create a smoke screen 15. The loading of the mixture 5 into the at least one canister 10 may comprise pressurized loading. The pressurized loading may comprise loading pressures in the range of approximately 2300 psi to approximately 3600 psi. The hexachloroethane may comprise approximately 30-40 parts by weight of the mixture 5, and in one embodiment may be 34.1%. The stannous oxide may comprise approximately 55-65 parts by weight of the mixture 5, and in one embodiment may be 58.2%. The aluminum may comprise approximately 5-10 parts by weight of the mixture 5, and in one embodiment may be 7.7%. The hexachloroethane may comprise a particle 12, and the hexachloroethane particle size may comprise approximately less than 850 μm. The stannous oxide may comprise a particle 13, and the stannous oxide particle size may comprise approximately less than 150 μm. The aluminum may comprise a particle 14, and the aluminum particle size may comprise approximately less than 75 μm, and preferably less than 45 μm. In this regard, having a finer/smaller aluminum particle size significantly increases the burn rate. The mixture is devoid of zinc chloride.

As mentioned, zinc chloride contains toxic and otherwise environmentally disadvantageous characteristics. Most attempts by the industry to replace zinc chloride with a safer alternative have involved using alkaline and alkali Earth metals due to their environmental friendly characteristics (e.g., these are found in salt water). Use of tin compounds has not been a practical solution to utilize due to their uncommon and unobvious use in pyrotechnic mixtures. The primary reason for this is the possibility of stannous chloride unintentionally being converted into stannic chloride, which is slightly more toxic. Indeed, due to the lack of previous or contemporary formulations, studies, and experiments involving tin components in pyrotechnics, use of stannous chloride has not been a potential choice by the industry in commercial or military pyrotechnic mixtures. Due to the lack of available data of tin as it relates to pyrotechnic reactions, the industry has never previously considered use of stannous chloride for pyrotechnics.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A white smoke producing mixture comprising hexachloroethane, stannous oxide, and aluminum, wherein said mixture reacts to produce stannous chloride ($SnCl_2$) for smoke generation.

2. The mixture of claim 1, wherein said hexachloroethane comprises approximately 30-40 parts by weight of said mixture.

3. The mixture of claim 1, wherein said stannous oxide comprises approximately 55-65 parts by weight of said mixture.

4. The mixture of claim 1, wherein said aluminum comprises approximately 5-10 parts by weight of said mixture.

5. The mixture of claim 1, wherein said hexachloroethane comprises particles having a particle size of less than approximately 850 μm.

6. The mixture of claim 1, wherein said stannous oxide comprises particles having a particle size of less than approximately 150 μm.

7. The mixture of claim 1, wherein said aluminum comprises particles having a particle size of less than approximately 45 μm.

8. The mixture of claim 1, wherein said mixture is devoid of zinc and does not produce zinc chloride.

9. The mixture of claim 2, wherein said hexachloroethane comprises approximately 34 parts by weight of said mixture.

10. The mixture of claim 3, wherein said stannous oxide comprises approximately 58 parts by weight of said mixture.

11. The mixture of claim 4, wherein said aluminum comprises approximately 8 parts by weight of said mixture.

* * * * *